US005099742A

United States Patent [19]

Meno

[11] Patent Number: 5,099,742

[45] Date of Patent: Mar. 31, 1992

[54] ELECTRONIC MUSICAL INSTRUMENT HAVING STRING BENDING EFFECT

[75] Inventor: Frank Meno, Pittsburgh, Pa.

[73] Assignee: University of Pittsburgh of the Commonwealth System of Higher Education, Pittsburgh, Pa.

[21] Appl. No.: 445,421

[22] Filed: Dec. 4, 1989

[51] Int. Cl.[5] ..... G10H 1/045; G10H 1/055

[52] U.S. Cl. ..... 84/690; 84/734; 84/739; 84/743; 84/718

[58] Field of Search ..... 84/734, 739, 740, 743, 84/313, 672, 674, 690, 718

[56] References Cited

U.S. PATENT DOCUMENTS

| | | | |
|---|---|---|---|
| 3,252,368 | 5/1966 | Jeffery et al. | 84/313 |
| 4,292,875 | 10/1981 | Nourney | 84/734 |
| 4,306,480 | 12/1981 | Eventoff et al. | 84/DIG. 24 |
| 4,429,607 | 2/1984 | Meno | 84/679 |
| 4,430,917 | 2/1984 | Pepper, Jr. | 84/690 |
| 4,430,918 | 2/1984 | Meno | 84/722 |
| 4,580,479 | 4/1986 | Bonanno | 84/626 |
| 4,676,134 | 6/1987 | Newell | 84/673 |
| 4,860,625 | 8/1989 | Mathews | 84/DIG. 24 |
| 4,939,971 | 10/1990 | Satoh | 84/313 |

*Primary Examiner*—William M. Shoop, Jr.
*Assistant Examiner*—B. Sircus
*Attorney, Agent, or Firm*—Arnold B. Silverman; Suzanne Kikel

[57] ABSTRACT

Apparatus for altering the output of an electronic string musical instrument responsive to bending of the string comprises a compressible electrically conductive member which has an electrical resistance which varies with the degree of compression applied and may be a conductive elastomer or a piezoresistive material. First and second holders are in contact with the conductive member and a current source is secured to the first holder and the string electrode secured to the second. Bending of the string causes the application of compression to the conductive member. The change in current flow is converted into an output which is a frequency variation which corresponds to the degree of bending of the string.

16 Claims, 1 Drawing Sheet

ELECTRONIC MUSICAL INSTRUMENT HAVING STRING BENDING EFFECT

BACKGROUND OF THE INVENTION

1. Field of the Invention

This invention relates to an apparatus and method for providing in an electronic musical instrument frequency variations which correspond to the bending of strings.

2. Description of the Prior Art

It has been known for many years that electronic components may be employed to augment or substitute for portions of traditional musical instruments. For example, the traditional acoustic guitar wherein mechanics and physics produced the sound have to a great extent been substituted for by electric guitars which have amplification systems associated therewith and with such guitars having varying degrees of electronic components which otherwise enhance the musical sounds which may be provided by the instrument.

It has been known to provide electronic guitars wherein compression applied to portions of the neck serves to alter the resistance or current carrying capacity. See U.S. Pat. Nos. 4,580,479 and 4,429,607.

U.S. Pat. No. 4,676,134 discloses the use in an electronic string instrument of a bend detector. Displacement of a string displaces a leaf spring and moves a Hall effect device closer to an associated permanent magnet. This is said to result in a change in the voltage generated by the Hall effect device and leads to a higher pitched sound.

Despite these prior art devices there remains a very real and substantial need for an improved means for providing in electronic musical instruments the sound effect achieved by string bending.

SUMMARY OF THE INVENTION

The present invention has met the above-described need. It employs a compressible electrically conductive member which is associated with a pair of holders, one of which is electrically connected to a current source and the other to string electrode means. Mechanical means are provided for applying responsive compress on to the bending of the string such that the conductive element has reduced electrical resistance. Means are provided for monitoring the voltage and converting the voltage into a frequency variation.

In a first and second embodiment of the invention one of the two holders is pivotally mounted with a string secured thereto such that bending of the string causes pivoting of one holder to thereby compress the conductive member. In a third embodiment of the invention bending of the string creates tension in the string which urges one of the holders into enhanced compressive contact with the conductive member. It is an object of the present invention to provide an effective means for providing in an electronic musical instrument the sound effect achieved by string bending.

It is a further object of the present invention to provide an apparatus and a method thereof wherein variations in electrical resistance in a portion of the electrical circuit of the instrument is effected responsive to string bending.

It is a further object of the present invention to provide such apparatus and a method thereof which is economical to create and is compatible with conventional electronic musical instruments.

These and other objects of the invention will be fully understood from the following description of the invention on reference to the illustrations appended hereto.

DETAILED DESCRIPTION OF THE DRAWINGS

Figure 1:
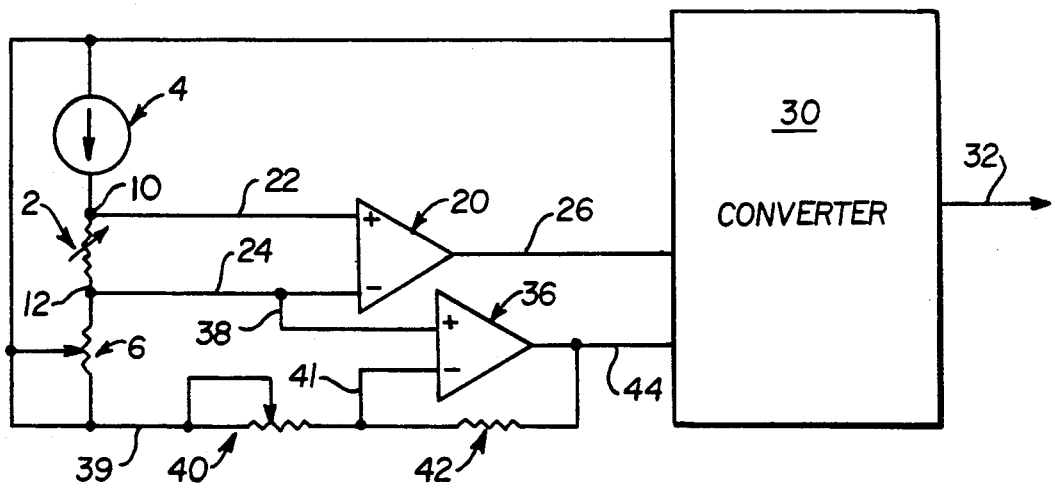
FIG. 1 is a schematic illustration of one embodiment of the present invention showing the electrical portion of the invention.

Referring to FIG. 1 there is shown a form of an electrical circuit which may be employed in the present invention. The compressible electrically conductive member 2 has been shown as being a variable resistor as compression of the member will reduce the electrical resistance therein. Current supply means 4 supplies current to one side of the conductive member 2. The string resistance 6 has been shown as being another variable resistance similar to that described in U.S. Pat. No. 4,430,918 issuing to the inventor on Feb. 14, 1984, and particularly shown in the electrical circuit of FIG. 3 of this U.S. Pat. No. 4,430,918 this disclosure of which is incorporated herein by reference. The current source means 4 supplies current to the conductive member 2 at point 10. The string electrode at point 12 connects the conductive member 2 with the string resistor 6.

The differential instrumentation amplifier 20 has its positive input connected with point 10 by lead 22 and its negative input connected to point 12 by lead 24 thereby providing an input to the differential amplifier 20 which is equivalent to the voltage across the conductive elastomer 2. Differential amplifier 20 provides an input over lead 26 to converter 30. The converter 30 which also serves as a modulator is adapted to output on lead 32 a frequency which varies in accordance with the degree of compression of conductive elastomer 2.

FIG. 1 also shows an operational amplifier 36 which receives its positive input over lead 38 from lead 24. The common lead 39 connects to a variable resistor 40 which with the resistor 42 at the negative input to the operational amplifier 36 at lead 41 controls its gain. Operational amplifier 36 provides input on lead 44 to converter 30 for generating the output frequency of the note or musical sound selected by the means of the string resistor 6. This frequency as stated herein is shown on lead 32.

Figure 2:
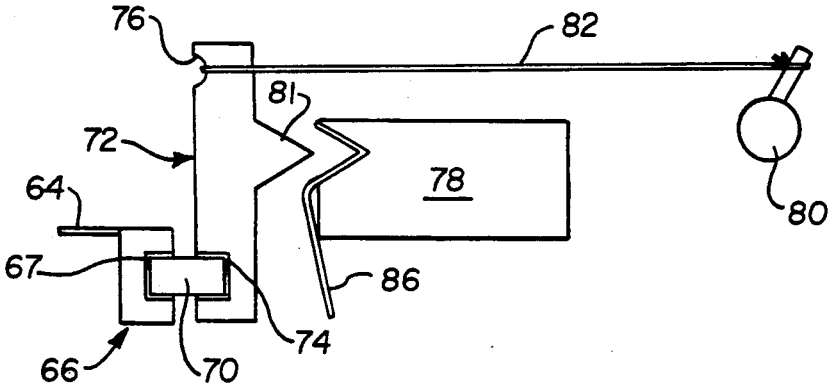
FIG. 2 is a schematic illustration of a first embodiment showing means for applying compression through a pivotal movement to a conductive member responsive to string bending.

Referring now to FIG. 2 a preferred means for a first embodiment for converting string bending into a responsive compressive force applied to the compressible electric conductive member will now be considered. A first holder 66 and a second holder 72 cooperate to support compressible electrically conductive member 70. The member 70, in the form shown, is received within recess 67 of a first holder 66 and recess 74 of second holder 72. Electrically conductive lead 64 connects the first holder 66 which is electrically conductive with the current supply means 4 (not shown in this Figure). The first holder 66 is adapted to be fixed in position and holder 72 is adapted to pivot in a V-groove of member 78. Holder 72 is provided with a recess 76 to which one end of string 82 corresponding to the string resistor 6 (FIG. 1) is secured with the other end of string 82 being wrapped around tuning peg 80. Holder 72 is adapted to pivot about pivot member 81 responsive to bending action applied to string 82. As string 82 is bent, it is placed in greater tension and causes the upper portion of second holder 72 to pivot in the V-groove of member 78 in a clockwise direction. Second holder 72 is electrically conductive and is in electrically conductive contact with string electrode 86 (point 12 in FIG. 1) through the pivot projection 81. Continuous electrical contact is maintained between lead 64 and lead 86 regardless of the position of the string 82. Pivot support 78 is secured in a fixed position by any desired means with respect to the remainder of the assembly.

In a preferred form of the invention of FIG. 2, the compressible, electrically conductive member 70 will be a conductive elastomer, and upon bending of the string 82 with 1 clockwise rotation of second member 72, member 70 will be compressed to thereby reduce the electrical resistance therein. Another preferred material for use as the conductive member 70 is piezoresistive means.

It is preferred that the first holder 66 and the second holder 72 be made of a material which is economically feasible, has desired strength, and has high conductivity, such as stainless steel. Holder 72 preferably has the same profile throughout its longitudinal extent, and may be about 0.50 to 0.75 inch in length, for example.

Figure 3:
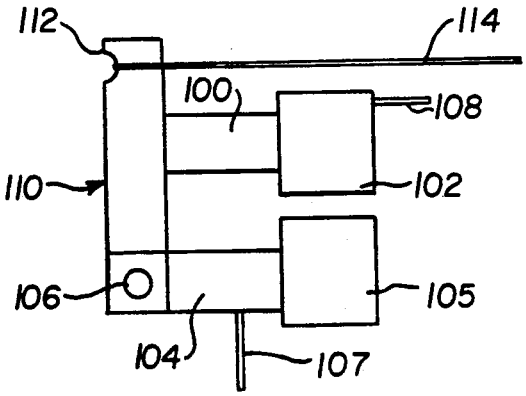
FIG. 3 is a schematic illustration of a second embodiment showing means for applying compression through a pivotal movement to a conductive member responsive to string bending.

Referring to a second embodiment of the invention, it will be seen in FIG. 3 that a compressible electrically conductive member 100 is secured between a first holder 102 and a second holder 110. A conductive connecting support 104 which is secured to structure member 105 has a pivot 106 to permit rotation of second holder member 110. Both first holder 102 and structure member 105 are held in a fixed position with second holder 110 pivoting at point 106. Second member 110 has a recess 112 within which string 114 is secured. By applying a bending action to the string 114 it will be placed in tension and cause rotation to member 110 in a clockwise rotation relative to FIG. 3. Electrical connections 107 and 108 in this FIG. 3 function similarly to electrical connections 64 and 86 of FIG. 2.

Figure 4:
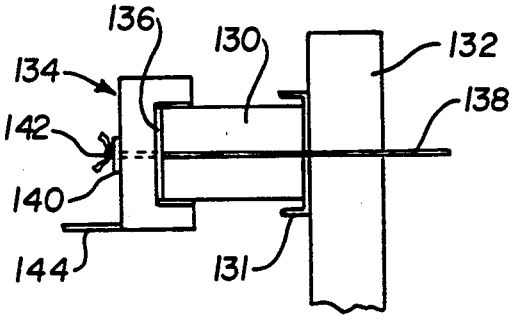
FIG. 4 is a schematic illustration of a third embodiment showing means for applying compression through a lateral movement to a conductive member responsive to string bending.

Referring now to FIG. 4 there is shown a third embodiment of the invention. There is shown a compressible electrically conductive member 130 which is in intimate contact with a string electrode 131 fastened to a second insulating support member 132 and a generally U-shaped support member 134 which has a recess 136 within which the compressible member 130 is received. String 138 passes through a retainer 140 and has a terminal knot 142 to maintain securement therein. Bending the string 138 will apply tension thereto and cause holder member 134 to be urged into a more intimate compressive relationship with the compressible electrically conductive member 130, thereby reducing its resistance. An electrical lead 144 is connected to member 134 and provides a current source thereto. Electrical connections 131 and 144 function similarly to components 64 and 86 of FIG. 2.

It will be appreciated, therefore, that the present invention has provided a simple and effective means for converting string bending into responsive changes in frequency thereby providing the electronic equivalent of the corresponding sound. All of this is accomplished in a manner which involves applying a compressive resistance reducing load to a portion of the system responsive to string bending. Electrical processing means convert the voltage changes in converter 30 (FIG. 1) to an output frequency change as shown at lead 32 in FIG. 1.

While for purposes of simplicity of disclosure a single system employed with a single string has been shown, it will be appreciated that the unit would generally be duplicated for each such strings and, in the case of the guitar, for example, would involve six such sub systems of FIG. 1.

For convenience of disclosure herein, reference has been made specifically to a guitar but it will be appreciated that the concept can be applied to other string instruments as well.

Whereas particular embodiments of the invention have been described above for purposes of illustration, it will be appreciated by those skilled in the art that numerous variations of the details may be made without departing from the invention as described in the appended claims.

I claim:

1. Apparatus for altering the output of an electronic string musical instrument responsive to bending of a string comprising:

a compressible electrically conductive member having an electrical resistance which varies with the degree of compressive force applied, a first holder member in contact with said conductive member, current source means for delivering current to said conductive member electrically connected to said first holder;

a second holder member in electrical contact with said conductive member, string electrode means for receiving current from said conductive member, and force applying means for applying compressive force to said conductive member responsive to bending of a said string, said force applying means including one of said holder members having pivotal means, and said string being secured to said pivoting holder member such that bending of said string will pivot said pivoting holder member and compress said conductive member.

2. An apparatus of claim 1 including said string being a string resistor.

3. Apparatus for altering the frequency of an electronic string musical instrument response to bending of a string comprising:

a compressible electrically conductive member having an electrical resistance which varies with the degree of compressive force applied, a first holder member in contact with said conductive member, current source means for delivering current to said conductive member electrically connected to said first holder, a second holder member in electrical contact with said conductive member, string electrode means for receiving current from said conductive member, said compressible member being disposed between said first holder member and said second holder member, at least one of said holder members being adapted for movement relative to the other said holder member, and said string being secured to said one holder member in a manner to cause said movement of said one holder member upon said bending of said string and for said applying of said compressive force to alter the electrical resistance of said compressible member, and thereby determine the output frequency of the musical sound selected by means of said string, said force applying means including one of said holder members having pivotal means, and said string being secured to said pivoting holder member such that bending of said string will pivot said pivoting holder member and compress said conductive member, and a pivot member operatively associated with said pivoting holder member, and said pivoting holder member having a projecting pivot portion which pivots about said pivot member.

4. The apparatus of claim 3 including said pivoting holder member having a recess to which said string is secured.

5. The apparatus of claim 4 including said pivoting holder member is said second holder member.

6. The apparatus of claim 4 including said pivoting holder member is said first holder member.

7. Apparatus for altering the frequency of an electronic string musical instrument response to bending of a string comprising:

a compressible electrically conductive member having an electrical resistance which varies with the degree of compressive force applied, a first holder member in contact with said conductive member, current source means for delivering current to said conductive member electrically connected to said first holder, a second holder member in electrical contact with said conductive member, string electrode means for receiving current from said conductive member, said compressible member being disposed between said first holder member and said second holder member, at least one of said holder members being adapted for movement relative to the other said holder member, and said string being secured to said one holder member in a manner to cause said movement of said one holder member upon said bending of said string and for said applying of said compressive force to alter the electrical resistance of said compressible member, and thereby determine the output frequency of the musical sound selected by means of said string, and means for converting electrical resistant changes in said conductive member due to compression into variations in output frequency of said apparatus, said converting means having a voltage to frequency converter, and said converting means including differential amplifier means receiving input from said current source means and said string electrode means.

8. The apparatus of claim 7 including said differential amplifier means providing input to said frequency converting means.

9. The apparatus of claim 8 including said string being a string resistor, and said converting means having operational amplifier means receiving input from said string electrode and said string resistor.

10. The apparatus of claim 9 including said frequency converter having means to modulate said frequency.

11. A method for altering the output of an electronic string musical instrument responsive to bending of a string, the steps comprising:

providing a compressible electrically conducting member with an electrical resistance which varies with the degree of applied compressive force, providing a first and a second holder in electrical contact with said conductive member, supplying current to said first holder for said electrical contact with said conductive member, with said second holder receiving said current, and applying a compressive force to said conductive member responsive to said bending of said string, causing pivotal movement of one of said first and second holders by said bending of said string for said applying of said compressive force to said conductive member.

12. A method for altering the frequency of an electronic string musical instrument responsive to bending of a string, the steps comprising:

providing a compressible electrically conducting member with an electrical resistance which varies with the degree of applied compressive force, providing a first and second holder in electrical contact with said conductive member, positioning said conductive member between said first and second holders, establishing movement of one of said holders relative to the other said holder, supplying current to said first holder for said electrical contact with said conductive member, with said second holder receiving said current, applying a compressive force to said conductive member responsive to said bending of said string to alter the electrical resistance of said compressible member, and thereby determine the output frequency of the musical sound selected by means of said string, causing pivotal movement of one of said first and second holders by said bending of said string for said applying of said compressive force to said conductive member, and securing said string to said one holder, which is pivotally mounted for said pivotal movement, such that said bending of said string pivots said one holder and compresses said conductive member.

13. A method for altering the frequency of an electronic string musical instrument responsive to bending of a string, the steps comprising:

providing a compressible electrically conducting member which an electrical resistance which varies with the degree of applied compressive force, providing a first and second holder in electrical contact with said conductive member, positioning said conductive member between said first and second holders, establishing movement of one of said holders relative to the other said holder, supplying current to said first holder for said electrical contact with said conductive member, with said second holder receiving said current, applying a compressive force to said conductive member responsive to said bending of said string to alter the electrical resistance of said compressible member, and thereby determine the output frequency of the musical sound selected by means of said string, converting electrical resistant changes in said conductive member into an output frequency variation value corresponding to the degree of said bending of said string, obtaining a voltage value across said compressible electrically conducting member and converting this voltage value into said frequency value, and providing a current source for said supplying of said current, and a current receiving means for said receiving of said current, and in said converting of said voltage value into said frequency value, directing the output from said current source and the output from said receiving means as input into a differential amplifier means.

14. A method of claim 13 including directing the output from said differential amplifier means and using this output for said conversion of said voltage value into said frequency value.

15. A method of claim 14 including providing an output by means of said string, and providing an operational amplifier means and directing the output from said receiving means and said output from said string, and using these output values in said operational amplifier means in combination with that output derived from said differential amplifier means for said conversion of said voltage value into said frequency value.

16. A method of claim 15 including modulating said frequency in said conversion of said voltage value into said frequency value.

* * * * *